United States Patent [19]

Wu et al.

[11] 3,955,128

[45] May 4, 1976

[54] CHARGED PARTICLE OPTICAL SYSTEM FOR CURVED MODULATORS

[75] Inventors: Alexander C. Wu, Wayne, Mich.; Shou L. Hou, Chagrin Falls, Ohio

[73] Assignee: Addressograph Multigraph Corporation, Cleveland, Ohio

[22] Filed: July 31, 1974

[21] Appl. No.: 493,206

[52] U.S. Cl. ..... 317/262 A; 96/1 R; 250/324

[51] Int. Cl.[2] ..... H01T 19/00

[58] Field of Search ..... 317/262 A; 250/324–326; 355/3, 16, 17; 96/1 R, 1 C

[56] References Cited

UNITED STATES PATENTS 2,824,813 2/1958 Fauser et al. ..... 250/324

3,680,954 8/1972 Frank ..... 355/3

*Primary Examiner*—J. D. Miller

*Assistant Examiner*—Harry E. Moose, Jr

[57] ABSTRACT

The invention deals with the construction and shape of the electrode employed in a duplicating apparatus which uses a drum shaped gas-ion modulating device. The curved modulator is matched with a curved gas-ion collecting electrode so that the propagation of the charged particles follows along the electrical field lines which are symmetrical about a center axis running longitudinally between the modulator and the collecting electrode. The ion optical system assures the production of a charge pattern on the dielectric paper that corresponds to the charge distribution system on the modulator.

13 Claims, 2 Drawing Figures

CHARGED PARTICLE OPTICAL SYSTEM FOR CURVED MODULATORS

BACKGROUND OF THE INVENTION

This invention relates generally to electrophotographic duplicating apparatus and, more particularly, is directed to the use of curvilinearly shaped foraminated image storing devices capable of having stored thereon charge patterns corresponding to light and dark areas of a graphic original. Such devices are known in this field as modulators. They are capable of selectively transmitting and otherwise blocking the passage therethrough of charged particles directed towards its surface in conformance to the charge pattern established thereon.

The term charge pattern will be referred to herein as the charge distribution system created on the modulator. The charge retaining portions will produce fields capable of either blocking the transmission of ions directed to the modulator or permitting them to be transmitted. For the purpose of the description of the invention which follows, the term charged particles will be deemed to define not only toner particles but also gas ions. The term block when used herein will describe the condition of the charged particle not passing through the aperture in the modulator due to its being attracted to the modulator or otherwise repelled from its surface and being returned into the stream of particles to again be projected elsewhere against the modulator. Charged particles which are referred to as being transmitted means that the field established across the aperture propels the particle through, or absent a field the charged particle will move through the aperture as part of its normal movement.

Various forms of modulators are known in this art. Some are constructed of two layers, others with three layers comprising a conductive layer, an intermediate layer of photoconductor material covered with a third insulating layer and still others with four layers. Depending on the arrangement of layers comprising the modulators, they will require different processing steps in order to provide a charge distribution system thereon, but in the final result, all modulators are capable of selectively transmitting or passing charged particles.

In certain of the two-layered constructions, it is necessary to maintain the pattern of light and shadow simultaneous with the projection of the gas ions, such as described in Snelling U.S. Pat. No. 3,220,324, since such a screen does not have a memory.

In the three-layer constructions, the modulator is capable of retaining the charge pattern on the insulating surface for extremely long periods of time and therefore produces a charge distribution system thereon which is capable of surviving independently of any simultaneous projection of the light pattern.

The operation and construction of the curvilinear electrodes of this invention will be described in the environment of a duplicating apparatus which utilizes a modulator having a charge distribution system defined herein, namely, a three-layer photoconductive screen having a substantially long memory. It will be understood, however, that the advantages and technical advancement in ion optics to be realized from practicing this invention can be realized to equal advantage with any type of foraminated structure capable of selectively blocking or transmitting charged particles therethrough to be collected on a dielectric receiving medium supported on a collecting electrode.

A detailed description of the operation and construction of the modulators referred to hereiin will be found in U.S. Pat. application Ser. No. 423,883, filed in the name of John D. Blades, et al, and assigned to the same assignee as the instant invention. The steps necessary to impart a charge distribution to the surface of such a modulator require the application of a blanket electrostatic charge to the insulating layer which results in the injection of oppositely poled charges into the conductive screen layer in the direction of the insulating layer. The injection of such oppositely poled charges, which ultimately are bound at the interface between the photoconductive layer and the insultating layer, occurs by virtue of the rectifying properties of the photoconductive layer. This dipole charge state could also be achieved by applying a blanket charge simultaneous with flood illumination using a non-rectifying photoconductor. The insulating layer will thereby have a uniform field applied across its thickness erasing any previous charges thereon.

As the next step, the modulator is given a simultaneous exposure to a corona electrode connected to an AC supply and pattern of light and shadow. The AC corona serves to erase the charges on the insulating layer. The charges which are bound at the interface are leaked to ground by virtue of the photoconductive layer being rendered conductive in response to exposure to electromagnetic radiation.

In the insulating areas corresponding to the dark portions of the pattern of light and shadow, the AC corona has the effect of connecting the insulating layer to the conductive layer causing some of the charges to be transferred to the metal base thereby causing oppositely poled charges to be bound at the interface between the photoconductive layer and the metallic layer. In the dark areas, therefore, the outer insulating layer and the conductive layer are at an equal potential level. The net charge across all three layers is zero, and the ability of the modulator to selectively block or transmit charged particles cannot occur until the entire surface is flood illuminated.

As a final step, the modulator is given a flood exposure of electromagnetic radiation which now causes the intermediate photoconductive layer to become conductive, including the previously unexposed portions causing any trapped charges to leak off to ground. This leaves only those charges that are bound at the interface between the photoconductive layer and the insulating layer by virtue of the charges present on the surface of the insulating layer. Hence, a dipole charge system is created across the insulating layer and those areas corresponding to the shadow or dark portions of the graphic original.

Having described the creation of a charge distribution system on the modulator, its utilization in a reproduction system requires that charged particles be projected onto the conductive surface of the modulator and provision made for the collection of those charged particles which are transmitted through the modulator onto a dielectric paper in an image-wise pattern and then developed according to conventional procedures.

Heretofore, the projection of such charged particles through modulators which were planar in their configuration could be arranged so that any collection electrode was in a plane parallel to the modulator. This arrangement obviated any problem of image distortion.

The instant invention deals with the construction and arrangement of the various electrodes necessary to achieve the movement, collection propagation of the gas ions transmitted through a curved modulator onto a collection electrode without any image distortion thereby achieving the same results that can be achieved by the electrode and the modulator when disposed in parallel planes with respect to one another.

SUMMARY OF THE INVENTION

The problem of projecting ions through a modulator having a curvilinear profile, so that the collection of the projected particle on a collecting electrode in a pattern which corresponds to the charge distribution system on the modulator is undistorted by virtue of the curved electrical field lines, is solved by the electrode constructions of the instant invention. It has been found that the problem of where a uniform and undistorted charge image is required is solved by using a collecting electrode having a curvilinear profile which matches the profile of the modulator thereby providing the geometry that causes charged particles eminating from the surface of the modulator to be directed to a corresponding location on the collecting electrode; i.e., it is a mirror image.

To achieve this geometry, the curvilinear surfaces, being described, are provided with inside and outside surfaces corresponding respectively to the concave and convex surfaces of the modulator. By placing the modulator and the collecting electrode with their outside surfaces in proximate relation to one another, gives rise to a geometry so that the systems are mirror images of one another in relation to a vertical axis passing midway between the two surfaces.

It is characteristic of the charged particles to move along the electric field lines present between electrodes by virtue of a potential difference between the surfaces. The modulator and the collecting electrode are deemed to be equipotential surfaces by virtue of the high conductivity of the materials. The collecting electrode and the screen are made of metal.

It is the general object of this invention to provide a duplicating apparatus equipped with a modulator having a curvilinear profile capable of projecting developable charge patterns onto a dielectric medium without distortion by providing a unique collecting electrode construction.

It is another object of this invention to provide a duplicating apparatus adapted to use a modulator in the shape of a drum equipped with an ion optic assembly capable of projecting and collecting ions on a dielectric medium so that the resulting image is undistorted and uniform.

It is a specific object of this invention to provide an ion optic assembly capable of projecting and collecting ions transmitted through a curved modulator by providing a matching curved collecting electrode to support the dielectric paper on which the charged particles are collected so that the pattern of electric field lines eminating from one electrode and terminating at the surface of the collecting electrode, on either side of the vertical line drawn midway between the two curvilinear surfaces, are mirror images of one another.

It is a further specific object of this invention to provide an improved ion optical system in which charged particles are transmitted from a curved modulator and collected on a dielectric paper supported on a curved plate electrode having the same radius of curvature as the modulator.

It is a still further specific object of this invention to provide an ion optical system in which charged particles are transmitted from a curved modulator onto a dielectric paper partially wrapped around a conductive drum wherein the radius of curvature of the drum is the same as the radius of the curved modulator.

Other objects, features, and advantages of this invention will become apparent to those skilled in this art from a reading of the following detailed description.

DETAILED DESCRIPTION OF THE INVENTION

Figure 1:
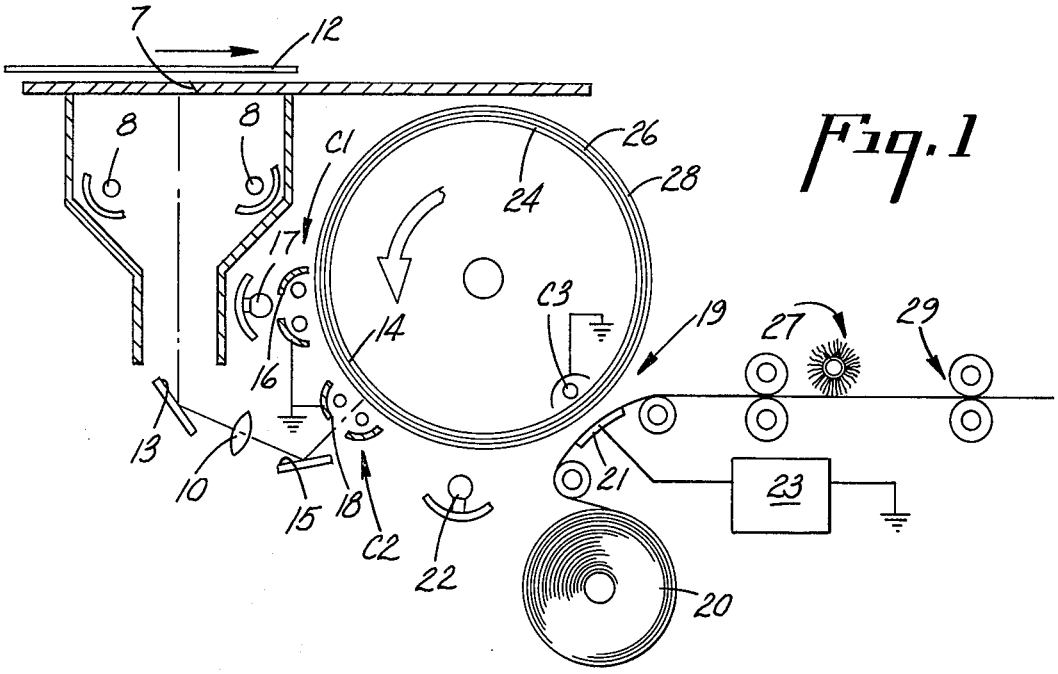
FIG. 1 is a schematic representation showing a typical duplicator apparatus employing the ion optical system of this invention.

Referring to FIG. 1, there is shown a duplicating apparatus which employs the ion optical arrangement of this invention in which the image storing device is a modulator 14 formed in the shape of a drum.

As shown in FIG. 1, there is provided a pair of lamps 8 for directing electromagnetic radiation onto an original document 12 which is adapted to move past an aperture 7 so as to effect an incremental or slit exposure of the graphic original as it moves past the aperture 7, thereby casting a pattern of light and shadow onto a reflective surface 13 in direct alignment with the aperture 7. A lens system 10 is in optical communication with the reflective surface 13 so that the pattern is projected onto a second reflective surface 15 and onto the cylindrically shaped modulator 14. As described hereinabove, the modulator 14 is of the three-layered construction comprising a metal layer 24, a photoconductive layer 26 and an insulating layer 28, having the capability of sustaining a charge distribution system on its surface for extended periods of time. It is understood that other foraminated structures may be used, such as a two-layered construction which requires different processing steps to create a charge pattern on its surface capable of discriminating the passage therethrough of impinging charged particles, but which nonetheless can take full advantage of the ion optical system of this invention.

The slit scan exposure of the document 12 is synchronized with the rotation of the cylindrically shaped modulator 14 such that the travel of the document 12 during scanning produces the same size image on the surface of the modulator. Although the speed of the cylinder is variably adjustable between 0 and about 30 inches per second, it has been experienced that the printing operation can be effected at higher speeds. Thus, the rotational speed of the modulator cylinder 14 is set to correspond with the relatively slow movement of the document 12 as it is being scanned, and thereafter, upon completion of the scanning operation, the rotation of the modulator cylinder may be increased to complete the reproduction steps subsequent to the creation of a charge distribution system on the surface of the modulator.

There is disposed about the surface 28 of the modulator 14 the various instrumentalities necessary for creating the charge distribution system on its surface. A corona charging device C1 is the first such instrumentality in the processing line up. The charging device C1 is equipped with a longitudinal opening 16 in the roof of the conductive shield to provide a passageway for electromagnetic radiation to be directed from a light source 17 against the surface of the modulator 14 simultaneously with the initial charging step. The simultaneous application of a blanket electrostatic charge accompanied by illumination conditions the photoconductive layer with the proper rectifying properties and at the same time erases any charges remaining from the previous imaging cycles.

As the modulator 14 rotates in the direction of the arrow shown in FIG. 1, it next encounters an AC corona unit C2, similar to the corona unit C1, which is equipped with a longitudinal opening 18 in its roof to provide an accessway for the pattern of light and shadow corresponding to the intelligence on the graphic original 12 to be directed onto the modulator surface simultaneously with the AC charging.

Flood illumination of the photoconductive surface is achieved by activating an electromagnetic radiation source 22 thereby producing the final charge distribution system capable of selectively passing charged particles through the curved modulator 14.

The important imaging process whereby the charged particles are projected through the modulator occurs at a charged particle imaging station (CPIS) identified generally by the reference character 19 which represents the point of novelty of the instant invention. A supply of dielectric paper 20 is unwound from a supply reel along a path directly adjacent the modulator 14. At the CPIS 19 there is positioned adjacent the inside surface of curvilinear modulator 14 a corona or emission electrode C3 for generating and projecting gas ions onto the inside metallic surface of the modulator. As explained earlier in this description, certain of the gas ions, depending on the polarities of the charged involved, will be permitted to pass through the modulator to be collected on the dielectric paper 20 while others of the charged particles or gas ions will be blocked and leaked off to ground. Because of the curvilinear profile of the modulator 14, special steps must be taken to avoid the distortion of those ions which are propagated through the modulator to be collected on the dielectric paper.

In order to control and move the gas ions passing through the modulator and onto the dielectric paper, there is provided a collecting electrode 21 which is connected to a high potential source 23 so as to establish a potential gradient between the emission electrode C3 and the electrode 21 and hence the necessary electrical field and field lines along which the gas ions are propagated. It is important to note that in the construction of the collecting electrode 21, it is provided with a curvilinear profile which coincides with the curvilinear profile of the modulator 14. The reference to matching profiles means that the radius of curvature of the electrode 21 is the same as the radius of curvature of the modulator 14.

Because the inside surface 24 of the modulator 14 is constructed of a highly conductive material such as metal and the electrode 21 is also constructed of metal, they are deemed to be equipotential surfaces so that the charge level is uniformly distributed across their respective surfaces.

The corona electrode C3 is connected to a DC potential source capable of supplying in a range of 3,500 volts to 13,000 volts to the corona wire. The curvilinear collecting electrode 21 is connected to a direct current high voltage source 23 capable of supplying in the ranage of 3,000 volts to 10,000 volts to this electrode.

The electrode C3 creates a field between the corona wire and the inside surface of the conductive layer of the modulator 14. In the circumstance that the corona wire is connected to the negative terminal of the high voltage supply source (not shown), lines of force would eminate from the conductive layer and be directed towards the corona wire. Operation of the modulator 14 is such that it is possible to selectively control the movement of gas ions through the modulator by selecting the appropriate polarities of the initial charge applied by the corona C1 to the insulating surface, as well as the projected ions emitted by the corona electrode C2. The modulator can be made to block gas ions at the apertures in the dark or the light zones thereof. The details of controlling the modulator are more fully described in application Ser. No. 423,883, filed in the name of John D. Blades, et al, and assigned to the same assignee as the instant invention and therefore need not be further described in connection with the instant invention.

Accordingly, certain of the impinging ions which are directed to the inside surface 24 of the modulator 14 will pass through and come under the influence of a collecting field produced by the collecting electrode 21. The electrode 21 is disposed in the system so that its outside surface (convex side) faces the outside surface 28 (convex side) of the modulator. The distance is approximately 0.25 inches. It will be appreciated that the rate of propagation of the gas ions coming under the influence of this field is a function of the strength of the field which in turn is inversely proportional to the distance between these two outside surfaces. The dielectric paper 20 on which the gas ions will collect in accordance with the pattern of light and shadow which, in turn, corresponds to the intelligence on the graphic original, is required to conform to the outside surface of the electrode 21. As the paper web emerges from the CPIS 19, it moves to developing station 27 where the charged particles are developed into a material image which is permanently fixed at the heat and/or pressure fixing station 29.

The range for the field strength between the emission electrode C3 and the inside surface 24 of the modulator 14 is 400 to 800 volts per centimeter. The output of the potential source 23 is in the range of 6,000 volts so that the gas ions that come under the influence of the field established between the two electrodes causes the ions to be propelled in the direction of the dielectric paper 20. The range for the field strength can be 500 to 12,000 volts per centimeter.

Figure 2:
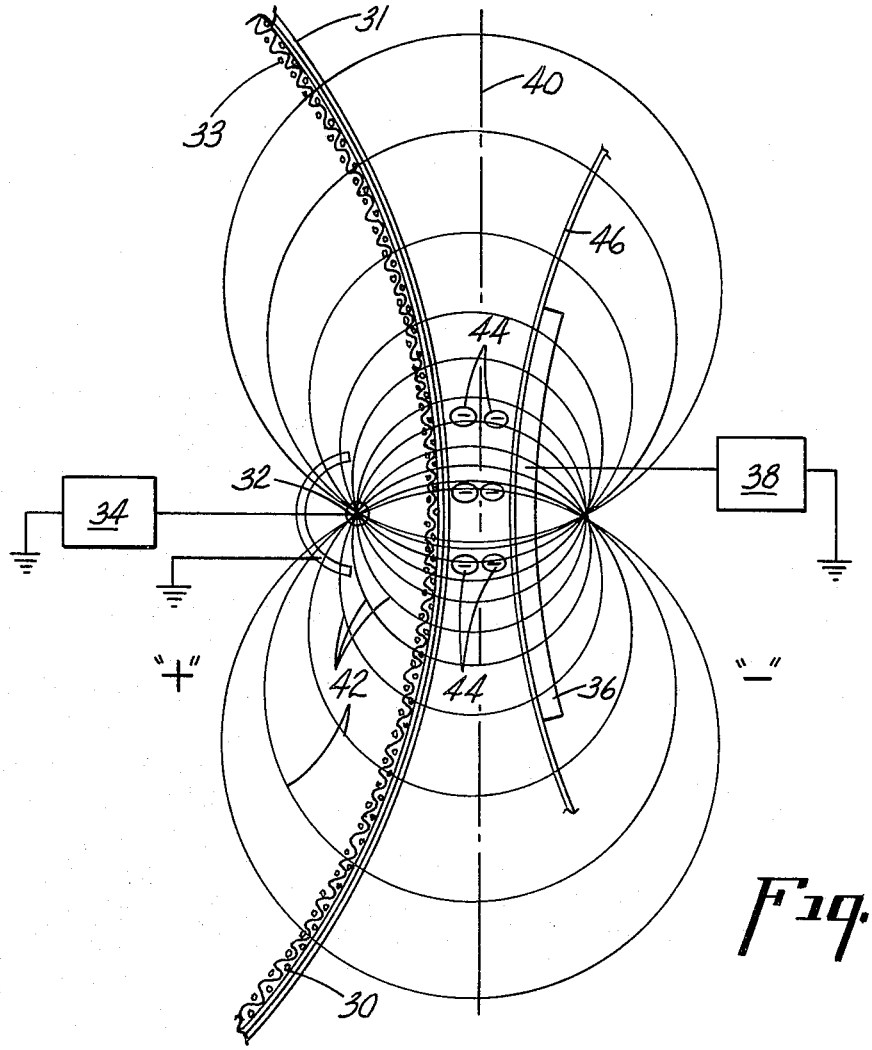
FIG. 2 is a schematic representation illustrative of the operation of the ion optical construction of this invention.

Because of the curvilinear profile of the modulator 14, it has been found that undistorted images can be produced on the dielectric paper 20 by providing an appropriately curved electrode 21 which provides the condition necessary to avoid any distortion or irregularities in the image which is produced on the dielectric paper 20. Referring to FIG. 2, there is shown a multilayered modulator 30 formed into a drum so that it presents an outside curved surface 31. Within the modulator 30 facing an inside surface 33, there is provided a corona emission electrode 32 which is connected to a high voltage source 34. The high voltage source 34 is capable of applying a potential in the range of 3,500 to 13,000 volts, preferably in the range of about 8,000 volts.

A curvilinear collection electrode 36 is positioned proximate the outside surface 31 of the modulator 30 with the distance between the two outside surfaces at their closest point being about 0.25 inches. The curvilinear electrode 36 is connected to a high voltage source 38 capable of applying a potential to the electrode 36 in the range of 3,000 to 10,000 volts, so that the field strength between the electrodes 32 and 36 is in the range of 500 to 12,000 volts per centimeter.

To illustrate the operation of the ion optical system shown in FIG. 2, a vertical axis 40 is drawn equidistant between the two outside surfaces. The contour of the electrical field established between the electrodes 32 and 36 is shown by the series of lines 42 passing through the equipotential surfaces 33 and the outside surface of the curvilinear conductive plate electrode 36. If the schematic diagram shown in FIG. 2 were folded along axis 40, the lines 42 on either side would line-up and coincide. In other words, the contour of the field lines of force representing the electric field or propagation field between the electrode 32 and the reference axis 40 and the contour of the field lines representing the electric field between the electrode 36 and the reference axis 40 are mirror images of one another.

As the gas ions 44 which passed through the apertures in the modulator 30 come under the influence of the electric field represented by the electrical field lines 42, they propagate along the lines 42 in the direction of a dielectric paper 46 which is in virtual contact with the outside surface of the electrode 36. It will be seen that each of the charged particles or ions 44 departing from a specific location on the outside surface 31 of the modulator 30 will be collected at a corresponding location on the surface of the dielectric paper 46 relative to the reference axis 40. In this manner, the propagation and collection of all of the charged particles which pass through the modulator 30 will conform in all respects and correspond precisely to the charge distribution system and the surface of the modulator 30.

It should be pointed out that the location of the electrode 32 within the drum shaped modulator 30 is not critical. Considering the inside conductive surface 33 of the modulator 30 as an equipotential surface, contoured field lines will be formed about the reference axis 40 if the emission electrode were located anywhere facing the general direction of the collection electrode 36. This is important for the reason that the ion optical system obviates the need for locating precisely an emission electrode in order to avoid any image distortion. Also, its distance from the equipotential surface is not critical since it is well understood that the field strength between the electrode 32 and the inside surface 33 will be proportionately decreased, as expressed in volts per centimeter, as the distance increases.

It is contemplated to vary the radius of curvature of only one of the elements in this invention to achieve image reduction or enlargement. By proportionately increasing or decreasing the radius, for example, of the collecting electrode, the image can be respectively enlarged or reduced.

In the description of the ion optical arrangement of the instant invention, the collecting electrode was described as a curved plate whose radius is the same as the radius of the modulator, the latter formed into the configuration of a drum or cylinder. It will be appreciated that in place of the curved plate a metallic cylinder can be utilized whose radius is the same as that of the modulator with the advantage of simplifying the paper drive system. The fact that the cylindrical collecting electrode is a rotatable element that moves with the paper, rather than have the paper slide over the curved plate electrode, provides better contact between the paper and the equipotential surface.

What is claimed is:

1. The process of making reproductions on dielectric material by projecting gas ions through a curved modulator comprising the steps of:

imparting a charge distribution system on said modulator having a curvilinear profile with inside and outside surfaces;

directing gas ions from an ion generating source against the inside surface of said modulator;

positioning a conductive electrode having a curvilinear profile generated by a radius of curvature that is the same as said modulator with inside and outside surfaces proximate to and in spaced relation from said modulator so that its outside surface faces the outside surface of the modulator;

establishing an electrical field between said electrode and said ion generating source; and passing dielectric paper over the outside surface of the conductive electrode.

2. The process as set forth in claim 1 wherein said curved modulator comprises a photoconductive layer sandwiched between a metal screen and a transparent insulating layer.

3. The process as set forth in claim 1 wherein said charge distribution system is produced by the process comprising the steps:

a. applying a blanket electrostatic charge simultaneous with illuminating the modulator with electromagnetic radiation;

b. applying the AC corona charge simultaneous with the projection of a pattern of light and shadow; and c. flood illumination of the outside surface of the modulator.

4. The process as set forth in claim 1 wherein the polarity of the charge distribution system and the polarity of the gas ions are of the same sign.

5. In a copying apparatus equipped with a modulator having a curvilinear profile with inside and outside surfaces and having a charge distribution system thereon, the combination comprising, a conductive collecting electrode having a curvilinear profile generated by a radius of curvature that is the same as said modulator with inside and outside surfaces and positioned proximate to and in spaced relation from said modulator with their respective outside surfaces facing one another, a high voltage source for applying potential to said collecting electrode of one polarity, and a gas ion generating source positioned adjacent the inside surface of said modulator projecting ions having a polarity opposite the polarity of the potential applied to said collecting electrode; and means for advancing dielectric paper across the outside surface of said collecting electrode, whereby a high intensity field is established between said outside surface of said collecting electrode and the gas ion generating source.

6. The apparatus as claimed in claim 5 wherein the voltage applied to said high voltage source is in the range of 3,000 to 10,000 volts.

7. The apparatus as claimed in claim 5 wherein said gas ion generating source produces an electrical field between said source and the inside surface of the modulator in the range of 400 volts per centimeter to 800 volts per centimeter.

8. In a copy making apparatus equipped with a modulator having a curvilinear profile and inside and outside surfaces, said modulator being imparted a charge distribution system thereon, the combination comprising:

a conductive collecting electrode having a curvilinear profile generated by a radius of curvature the same as said modulator with inside and outside surfaces and positioned proximate to and in spaced relation from said modulator with their respective outside surfaces facing one another;

means for establishing an electrical field between the outside surface of the conductive electrode and the inside surface of the modulator;

means for advancing dielectric paper across the outside surface of said conductive electrode; and a corona emission electrode positioned adjacent the inside surface of said modulator for establishing a projection field between said last named electrode and said inside surface of said modulator.

9. The apparatus as claimed in claim 8 wherein the electrical field pattern established between the outside surface of the conductive electrode and the inside surface of the modulator is symmetrical about a plane which is equidistantly positioned between said outside surfaces.

10. The apparatus as claimed in claim 8 in which the collecting electrode is a drum connected to a high voltage source.

11. The apparatus as claimed in claim 8 in which the collecting electrode is a curvilinear plate.

12. The apparatus as claimed in claim 8 in which the electrical field between said emission electrode and said inside surface is in the range of 400 to 800 volts per centimeter.

13. The apparatus as claimed in claim 8 in which the electrical field between said conductive electrode and said emission electrode is in the range of 500 to 12,000 volts per centimeter.

* * * * *